US010304643B1

(12) United States Patent
Domzalski

(10) Patent No.: US 10,304,643 B1
(45) Date of Patent: May 28, 2019

(54) SINGLE-POLE, SINGLE-THROW DETECT SWITCH

(71) Applicant: COACTIVE TECHNOLOGIES, LLC, Newton, MA (US)

(72) Inventor: Frank Domzalski, Wellesley, MA (US)

(73) Assignee: CoActive Technologies, LLC, Newtown, MA (US)

( * ) Notice: Subject to any disclaimer, the term of this patent is extended or adjusted under 35 U.S.C. 154(b) by 0 days.

(21) Appl. No.: 15/907,377

(22) Filed: Feb. 28, 2018

(51) Int. Cl.
*H01H 13/14* (2006.01)
*H01H 15/10* (2006.01)
*H01H 15/24* (2006.01)

(52) U.S. Cl.
CPC ..... *H01H 15/102* (2013.01); *H01H 15/24* (2013.01); *H01H 2205/004* (2013.01); *H01H 2205/032* (2013.01); *H01H 2221/058* (2013.01)

(58) Field of Classification Search
CPC ..... H01H 13/48; H01H 13/52; H01H 13/56; H01H 13/20; H01H 13/36; H01H 13/365; H01H 15/02; H01H 15/06; H01H 1/242
USPC ..... 200/11 J, 16 C, 61.74, 450, 453, 458, 200/459, 276, 290, 325, 5 A, 341–345, 200/314
See application file for complete search history.

(56) References Cited

U.S. PATENT DOCUMENTS 2,743,331 A 4/1956 Lauder et al.
3,098,905 A 7/1963 Anderson
3,809,837 A 5/1974 Yoshioka
6,399,908 B1 6/2002 Mueller et al.
6,753,489 B2 6/2004 Kiyono et al.
8,362,375 B2 1/2013 Wildman
9,613,765 B2 4/2017 Koepsell
2010/0025205 A1 2/2010 Domzalski
2011/0147186 A1 6/2011 Mori et al.

OTHER PUBLICATIONS

SPVQ8 Series—Basic information, from ALPS, downloaded from the internet Jan. 4, 2018, http://www.alps.com/prod/info/E/HTML/Switch/Detector/SPVQ8/SPVQ850300.html.
Panasonic Automation Controls Catalog, Turquoise Stroke Mini Switches (ASQM1) datasheet.

*Primary Examiner* — Ahmed M Saeed
(74) *Attorney, Agent, or Firm* — Fox Rothschild LLP

(57) ABSTRACT

A switch including a housing and an actuator configured to move axially within the housing. The actuator includes a guide wing on a first side and a cam wing on a second side, wherein the cam wing has a cam surface on one face. The switch also includes respective first and second contact terminals partially extending from the housing, as well as a movable contact element retained within the housing proximate the contact terminals. The movable contact element includes a fixed branch, a first elastically deformable conductive blade, and a second elastically deformable conductive blade. The cam surface on the actuator is configured to cooperate with the first elastically deformable conductive blade to deform or relax the first elastically deformable conductive blade so as to selectively contact the first contact terminal dependent upon the axial position of the cam wing within the housing.

20 Claims, 7 Drawing Sheets

SINGLE-POLE, SINGLE-THROW DETECT SWITCH

BACKGROUND

This document relates to an electrical switch and, more specifically, to a single-pole, single-throw switch which may be used as a detect switch in a motor vehicle, e.g., in association with a door latch.

Electrical switches have been designed for selectively establishing at least a first conductive way between two conductive fixed contacts, the switch having a housing and a pushbutton arranged such that when an external force is applied to the pushbutton, the pushbutton is moved relative to the housing between a first position in which the conductive way is established and a second position in which the conductive way is interrupted. This conductive way (and, thus, the switch) can be of the normally-open (NO) type or of the normally-closed (NC) type.

According to a known design, such a switch might be of the "snap switch" type, such as those illustrated in U.S. Pat. No. 2,743,331 and/or U.S. Pat. No. 3,098,905. In such a design, the switch has a high current carrying capacity and a relatively long life duration. However, the "snapping" or "clicking" noise present in such a switch may be detrimental in some applications, and a hysteresis may be present. A snap switch also has a limited over travel capacity.

According to another known design, the switch might be of the "slide switch" type, such as that illustrated in U.S. Patent Application Publication No. 2011/0147186, wherein a sliding contact arrangement is disclosed in combination with a snapping arrangement. In such a design, there is no detrimental noise, nor is there any hysteresis. However, slide switches of this type cannot adequately carry medium or high currents and may have a relatively short life duration. One reason slide switches may be limited in this way is due to the fact that plastic and metal within the switch are in contact with one another when the switch changes state. Thus, medium-to-high currents may cause the plastic to melt, thereby tracking plastic onto the electrical contacts, causing high contact resistance and/or poor tactile feel during switch operation. Additionally, actuators used in slide switches may be sensitive to lateral forces, thereby limiting the placement and/or actuation options of the switches.

U.S. Pat. No. 6,753,489 discloses an electrical switch having a housing with a receiving portion, an actuation member comprising an actuating portion extending into the housing and arranged to be moved vertically between a pushbutton upper position and a pushbutton lower position, a pair of associated contact elements comprising a fixed contact element provided in the receiving portion, a movable contact element arranged facing the fixed contact element and that may come into contact with the fixed contact element for establishing a conductive switching way between the movable contact element and the fixed contact element, and an elastically deformable conductive blade in the form of a hairpin supported by the receiving portion. The blade includes a movable active branch.

In U.S. Pat. No. 6,753,489, the active branch of the hairpin-shaped blade is pivotally mounted with respect to the housing—around a horizontal pivotal axis—between a first active position in which a first switching way is established and a second switching way is interrupted, and a second active position in which the first switching way is interrupted and the second switching way is established. To provoke the pivotal movement of the active branch, the actuating portion is in the form of a cam acting on the other branch of the hairpin shaped blade.

According to such a design, the pivotal movement of the active branch tends to produce a loud snapping effect, and the two switching ways cannot be controlled independently. Also, in case of medium or high currents, the "floating" design of the blade does not permit electrical connection of the blade to the outside of the switch.

Accordingly, there is a need for a detect switch having a design that results in little or no hysteresis, that is relatively silent, and that may permit the carrying of medium or high currents.

SUMMARY

In accordance with an aspect of the disclosure, an electrical switch is disclosed, the electrical switch including a housing and an actuator configured to move axially within the housing between an upper position and a lower position. The actuator includes a free upper end positioned at least partially outside of the housing and configured to receive a downward external force, a stem extending at least partially outside of the housing, wherein the free upper end is disposed on a distal end of the stem, a guide wing extending laterally from a first side, and a cam wing extending laterally from a second side opposite the first side, wherein the cam wing comprises a cam surface extending from a face of the cam wing. The electrical switch also includes a first contact terminal partially extending from the housing opposite the free upper end of the actuator, the first contact terminal having a first fixed contact plate disposed within the housing, and a second contact terminal partially extending from the housing opposite the free upper end of the actuator, the second contact terminal having a second fixed contact plate disposed within the housing. The electrical switch further includes a movable contact element retained within the housing proximate the first fixed plate and the second fixed contact plate, the movable contact element having a fixed branch, the fixed branch configured to be retained on an inner surface of the housing, a first elastically deformable conductive blade extending from a first side of the fixed branch, the first elastically deformable conductive blade having a first movable contact face, and a second elastically deformable conductive blade extending from a second side of the fixed branch opposite the first side, the second elastically deformable conductive blade having a second movable contact face. The cam surface on the cam wing of the actuator is configured to cooperate with the first elastically deformable conductive blade to deform or relax the first elastically deformable conductive blade for longitudinally moving the first movable contact face to come into contact, or out of contact, with the first fixed contact plate, dependent upon an axial position of the actuator within the housing.

According to another aspect of the disclosure, an electrical switch is disclosed, the electrical switch including a housing, the housing having an interior portion having a guide rib extending from a first sidewall and a guide wall extending from a second sidewall opposite the first sidewall, as well as an actuator at least partially supported by the guide rib and the guide wall and configured to move axially within the housing between an upper position and a lower position. The actuator includes a guide wing extending laterally from a first side, and a cam wing extending laterally from a second side opposite the first side, wherein the cam wing includes a cam surface extending from a face of the cam wing. The electrical switch also includes a first contact terminal partially extending from the housing, the first contact terminal having a first fixed contact plate disposed within the housing, a second contact terminal partially extending from the housing, the second contact terminal having a second fixed contact plate disposed within the housing, and a movable contact element retained within the housing proximate the first fixed plate and the second fixed contact plate. The movable contact element includes a fixed branch, the fixed branch configured to be retained on an inner surface of the housing, a first elastically deformable conductive blade extending from a first side of the fixed branch, the first elastically deformable conductive blade having a first movable contact face, and a second elastically deformable conductive blade extending from a second side of the fixed branch opposite the first side, the second elastically deformable conductive blade having a second movable contact face. The cam surface on the cam wing of the actuator is configured to cooperate with the first elastically deformable conductive blade to deform or relax the first elastically deformable conductive blade for longitudinally moving the first movable contact face to come into contact, or out of contact, with the first fixed contact plate dependent upon an axial position of the actuator within the housing.

BRIEF DESCRIPTION OF THE FIGURES

Other characteristics and advantages of the disclosure will become apparent from reading the following detailed description, for an understanding of which reference should be made to the appended drawings in which.

DETAILED DESCRIPTION

The following description is made for the purpose of illustrating the general principles of the present system and method and is not meant to limit the inventive concepts claimed in this document. Further, particular features described in this document can be used in combination with other described features in each of the various possible combinations and permutations.

Unless otherwise specifically defined in this document, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to". Additionally, use the term "couple", "coupled", or "coupled to" may imply that two or more elements may be directly connected or may be indirectly coupled through one or more intervening elements.

In this document, position-identifying terms such as "vertical", "horizontal", "front", "rear", "side", "top", and "bottom" are not intended to limit the invention to a particular direction or orientation, but instead are only intended to denote relative positions, or positions corresponding to directions shown when a switch or related component is oriented as shown in the Figures.

Figure 1:
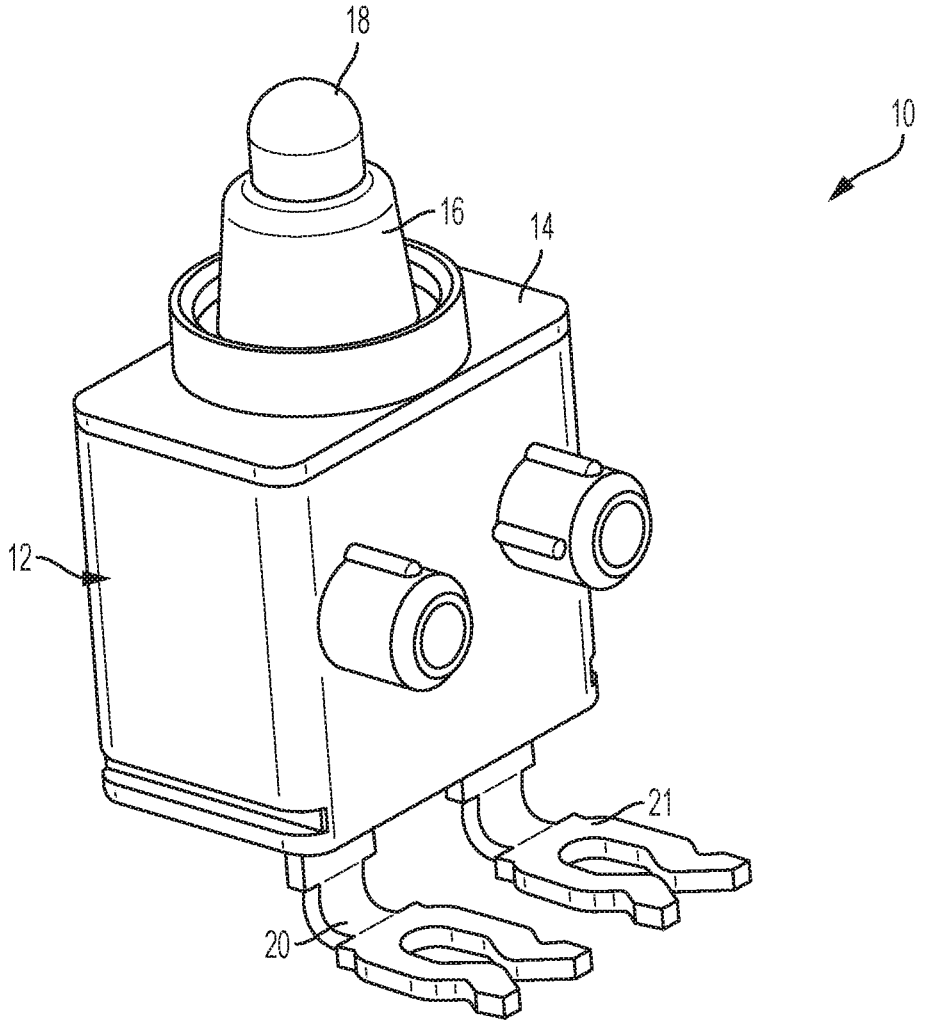
FIG. 1 is a perspective view of a single-pole, single-throw (SPST) switch in accordance with an aspect of the disclosure.
Figure 2:
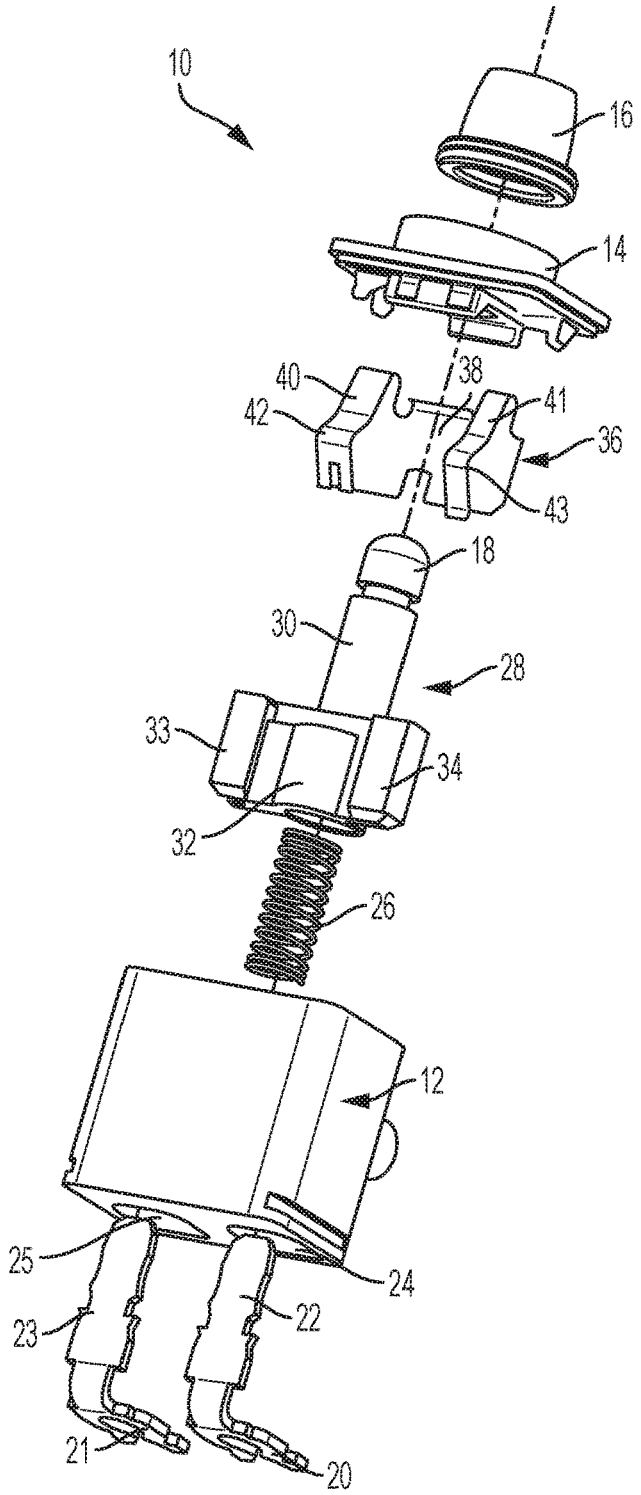
FIG. 2 is an exploded view of the switch of FIG. 1.

Referring to FIGS. 1 and 2, a switch 10 in accordance with an aspect of the disclosure is illustrated. Switch 10 includes a housing 12, with housing 12 having a rectangular parallelepipedic shape. An upper cover part 14 is couplable to the housing 12, with the interior of housing 12 defining a receiving portion for various components of switch 10. Both housing 12 and upper cover part 14 may be constructed of moulded or otherwise formed plastics or other materials. Additionally, housing 12 and/or upper cover part 14 may be ultrasonic welded after mounting and assembly.

The switch 10 includes a vertically-extending and displaceable actuator 28 having a free upper end 18, with free upper end 18 and a stem 30 of actuator 28 extending through an opening in upper cover part 14 and configured to receive an external actuation force. A sealing boot 16 at least partially surrounds stem 30 and is coupled with upper cover part 14 so as to effectively seal switch 10, while still allowing for vertical axial movement of actuator 28. While not shown, switch 10 may include an elastically-deformable lever to provide the actuation force on free upper end 18. However, switch 10 is not limited to use with such a lever, and actuator 28 may receive actuation force through any appropriate means, or may be directly actuated.

A first terminal 20 and a second terminal 21 each extend from housing 12 at a location opposite the upper cover part 14. While illustrated as right-angle terminals in FIGS. 1 and 2, it is to be understood that first terminal 20 and second terminal 21 are not limited as such, and may be any appropriate terminal configuration such as, e.g., fork terminals, pin terminals, solder lug terminals, etc. As shown in FIG. 2, first terminal 20 includes a first fixed contact plate 22 and second terminal 21 includes a second fixed contact plate 23, with first fixed contact plate 22 and second fixed contact plate 23 being configured to provide conductive contacts within housing 12, as will be described further below. The external portion of first terminal 20 is configured to extend from a first opening 24 in housing 12, while the external portion of second terminal 21 is configured to extend from a second opening 25. Alternatively, first terminal 20 and second terminal 21 may be insert moulded into housing 12.

Figure 3:
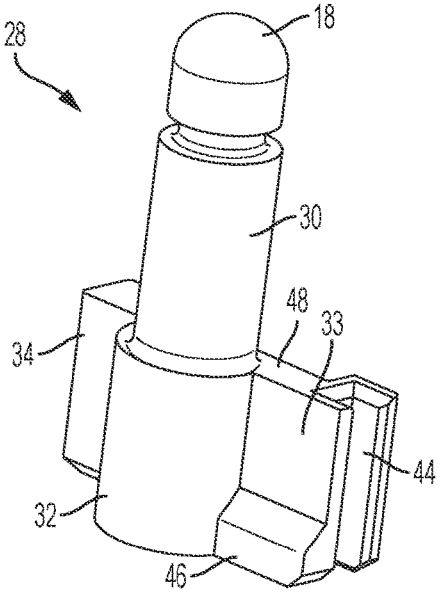
FIG. 3 is a top perspective view of an actuator for use with the switch of FIG. 1.
Figure 4:
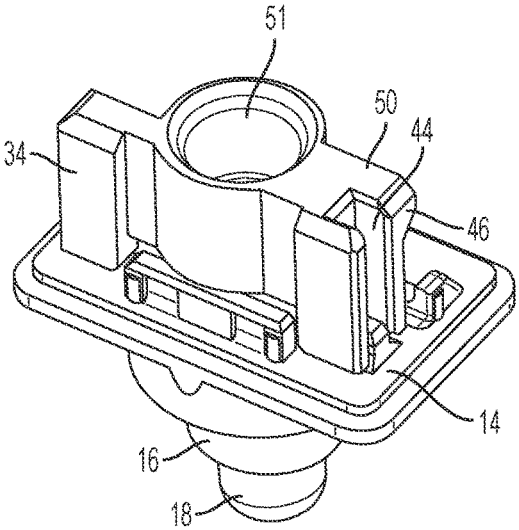
FIG. 4 is a bottom perspective view of an actuator and cover for use with the switch of FIG. 1.

Referring to FIGS. 2-4, the actuator 28 includes a core portion 32 from which stem 30 extends. Extending from a first side of core portion 32 is a guide wing 34, while extending from a second, opposite side of core portion 32 is a cam wing 33. With this configuration, stem 30 is well supported on core portion 32, allowing for actuator 28 to withstand significant laterally-directed forces during actuation as compared to prior art implementations.

As will be described in further detail below, guide wing 34 is configured to simply provide a guided support for actuator 28 as actuator 28 moves axially within housing 12. However, cam wing 33 is not only configured to provide guided support for actuator 28 via a guide slot 44, but is also configured to effectuate opening or closing a switch contact by way of a cam surface 46 located on cam wing 33.

In some embodiments, travel of actuator 28 is limited in a first direction by contact of a top surface 48 of actuator 28 with a bottom (or inward-facing) surface of upper cover part 14, while travel of actuator 28 is limited in a second, opposite direction by contact of a bottom surface 50 of actuator 28 with a bottom inner surface (not shown) of housing 12. In accordance with one aspect of the disclosure, actuator 28 is formed as a single, moulded plastic piece. However, it is to be understood that actuator 28 may be formed of multiple pieces, and/or may be formed of materials (and by methods) other than moulded plastic.

The switch 10 also includes a return spring 26, which is disposed vertically between the bottom inner surface of the housing 12 and the actuator 28. In the embodiment shown, the return spring 26 is a vertically and helicoidally wound spring which is received on a centering pin 60 (see FIG. 8A) on the bottom inner surface of housing 12, while the opposite end of return spring 26 is received in a recess 51 (see FIG. 4) formed in the bottom surface 50 of actuator 28. Other types of spring structures may be used, so long as the return spring 26 is mounted so as to be vertically compressed in such a way that when an external force applied downwardly to the free upper end 18 of the actuator 28 is removed, the actuator 28 is returned to an upper rest position by the return spring 26. Furthermore, by being supported on the inside by centering pin 60 and on the outside by recess 51, return spring 26 is capable of operating smoothly, without "clicking" of the coils making up return spring 26.

Figure 5:
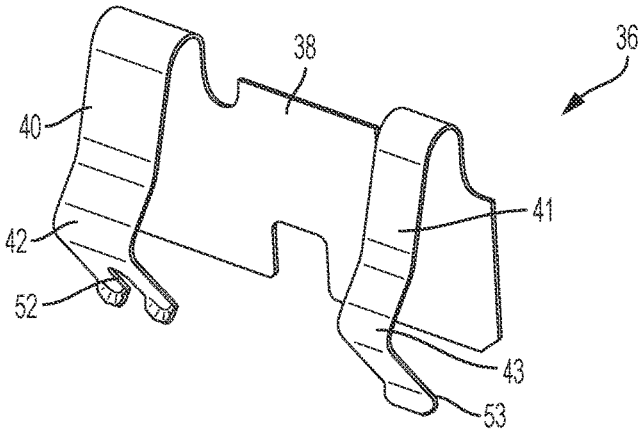
FIG. 5 is a top perspective view of a movable contact element for use with the switch of FIG. 1.

Next, referring to FIGS. 2 and 5, the switch 10 further includes a bifurcated movable contact element 36. Movable contact element 36 includes a fixed branch 38, wherein fixed branch 38 joins a first deformable conductive blade 40 and a second deformable conductive blade 41. The movable contact element 36 may be formed of a singular cut and bent sheet of conductive metal having, in cross section, a general shape of a hairpin. As illustrated in FIG. 5, first deformable conductive blade 40 includes a first movable contact face 52, while second deformable conductive blade 41 includes a second movable contact face 53. While not shown in FIGS. 2 and 5, for accommodating medium or high current, one or both of the first movable contact face 52 and the second movable contact face 53 may be equipped with a contact pill, wherein the contact pill is a conductive element that extends outward from the movable contact face 52 and/or 53 for making electrical contact with one or more respective terminals of the switch 10. A contact pill may be rounded, square, rectangular, ridged or formed or of other shapes, and may be coupled to the movable contact face(s) in any way, including by a weld, by a press fit, or by another type of mechanical connection. However, use of a contact pill is optional, particularly in low current applications, as an electrical connection may be established between the respective movable contact faces and the respective terminals alone.

First deformable conductive blade 40 also includes a first blade summit 42, while second deformable conductive blade 41 includes a second blade summit 43. As will be described further below, first blade summit 42 and second blade summit 43 each provide a suitable contact surface upon which the respective deformable conductive blades 40, 41 may be displaced from an "open" position (i.e., respective movable contact faces 52, 53 not in contact with respective fixed plates 22, 23) to a "closed" position (i.e., respective movable contact faces 52, 53 in contact with respective fixed plates 22, 23).

Figure 6:
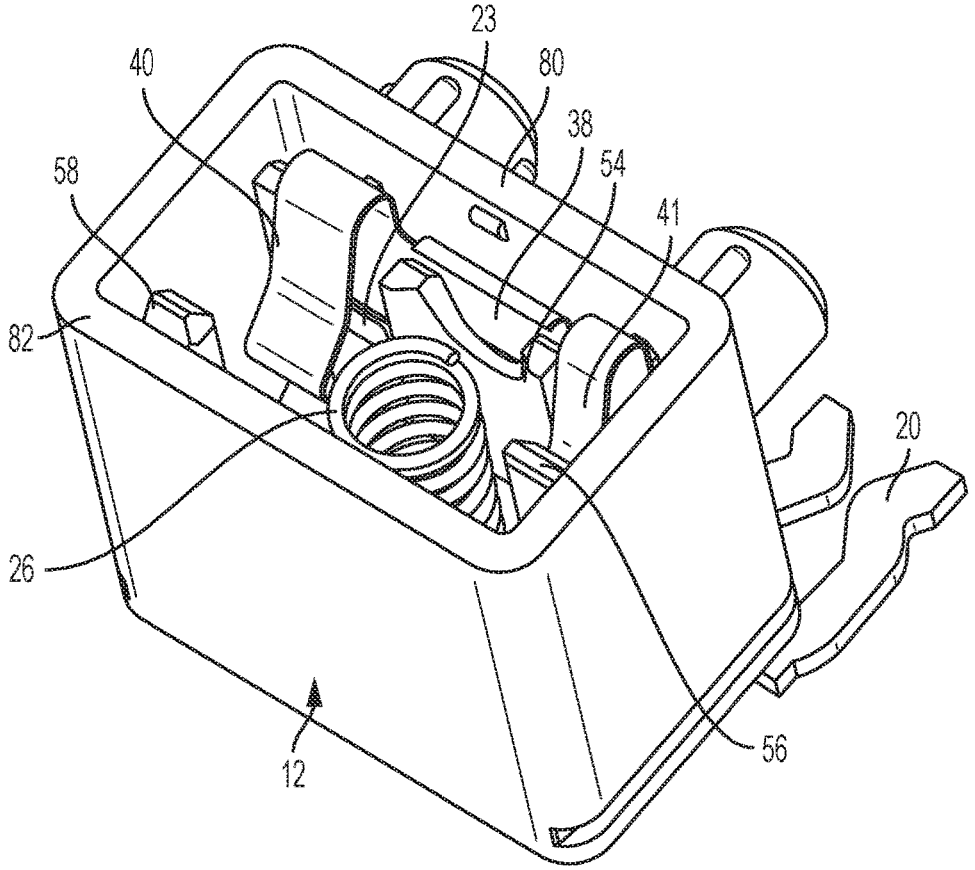
FIG. 6 is a top perspective view of various internal components of the switch of FIG. 1.
Figure 7:
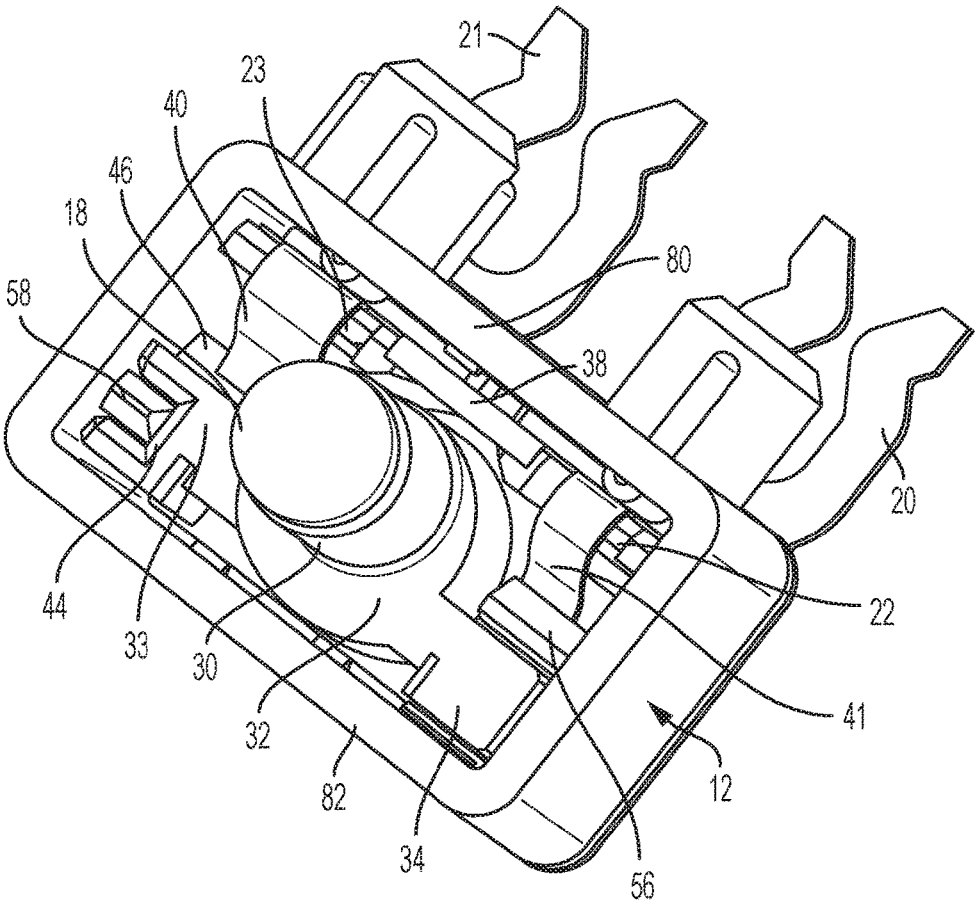
FIG. 7 is another top perspective view of various internal components of the switch of FIG. 1.

Referring now to FIGS. 6 and 7, greater detail of various components of switch 10 within housing 12 are shown. As shown in FIGS. 6 and 7, fixed branch 38 of movable contact element 36 is supported between a front wall 80 and a brace 54 within housing 12. In this way, fixed branch 38 is held stationary within housing 12, while first deformable conductive blade 40 and second deformable conductive blade 41 are permitted to flex laterally in the direction of fixed branch 38. Fixed branch 38 may be secured to front wall 80 by any appropriate means, including, e.g., a snap-fit engagement with brace 54, an adhesive, etc.

As shown in FIGS. 6 and 7, second deformable conductive blade 41 is positioned within housing 12 such that it is held in a "closed" position by a guide wall 56 extending partially into the interior space of housing 12. That is, movable contact element 36 is positioned within housing 12 such that guide wall 56 holds second deformable conductive blade 41 in an inwardly-deflected position, thereby causing the second movable contact face 53 (not shown in FIGS. 6-7) to contact the first fixed contact plate 22 of first terminal 20. In this way, second movable contact face 53 is always held in electrical contact with first fixed contact plate 22, regardless of the sliding position of actuator 28 within housing 12, as no portion of actuator 28 is in frictional contact with second deformable conductive blade 41. Thus, first terminal 20 acts as a common terminal, and the common connection between second movable contact face 53 and first terminal 20 is fixed.

Conversely, as shown in FIG. 7, first deformable conductive blade 40 is configured to contact cam wing 33 of actuator 28. Cam wing 33 includes a cam surface 46, with cam surface 46 configured to extend in the direction of first deformable conductive blade 40 in order to effectuate opening or closing of contact between the first movable contact face 52 and the second fixed contact plate 23, depending upon the axial position of the actuator 28 within housing 12. As will be described in further detail below, the position of the cam surface 46 on cam wing 33 alone determines whether switch 10 is a "normally-open" or a "normally-closed" switch, and the actuator 28 may be easily customized during the manufacturing process to change the location of cam surface 46, dependent upon application requirements, customer preferences, etc.

Referring still to FIG. 7, actuator 28 is shown with guide wing 34 positioned between a rear wall 82 and guide wall 56. Similarly, guide slot 44 in cam wing 33 of actuator 28 is configured to cooperate with guide rib 58 of housing 12. Both guide wing 38 and guide slot 44 provide lateral support for actuator 28 within housing 12, while still allowing actuator 28 to slide axially within housing 12 with minimal frictional resistance. Accordingly, actuator 28 is capable of smooth transitions between the "on" and "off" positions of switch 10. Furthermore, as only the first deformable conductive blade 23 is in contact with the actuator 28, the force necessary to axially move actuator 28 is reduced as compared to switches having actuators in contact with two (or more) deformable conductive blades, each of which increase the frictional resistance between the actuator and movable contact element.

Figure 8A:
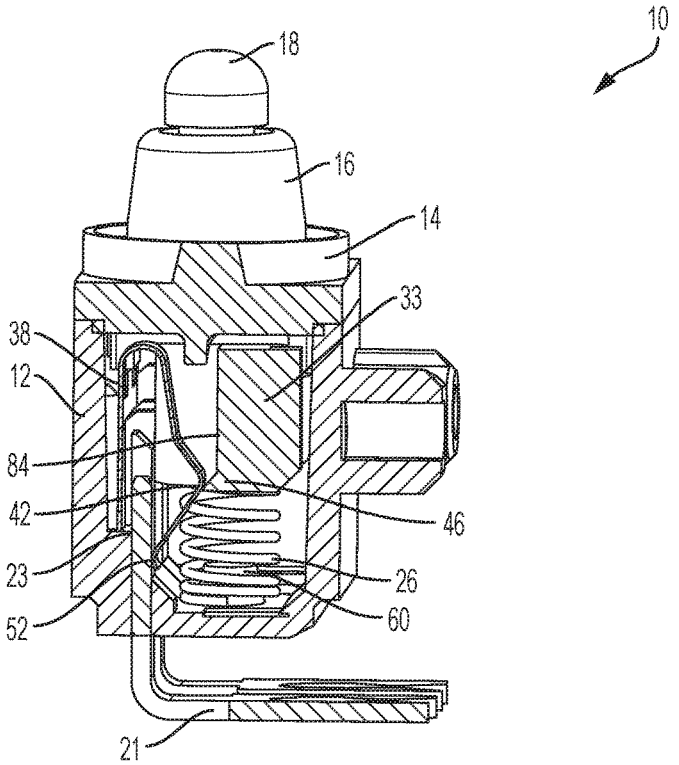
FIG. 8A is a normally-closed switch in a first position in accordance with an aspect of the disclosure.
Figure 8B:
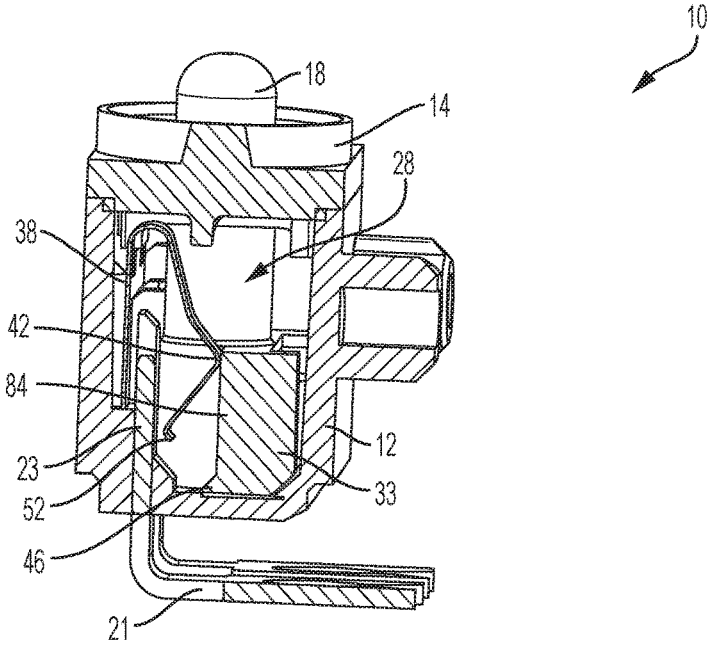
FIG. 8B is the normally-closed switch of FIG. 8A in a second position in accordance with an aspect of the disclosure.

Next, referring to FIGS. 8A and 8B, switch 10 in accordance with one aspect of the disclosure is illustrated. Specifically, switch 10 is shown in a "normally-closed" configuration. As shown in FIG. 8A, actuator 28 is in its "up" position, with return spring 26 holding the top surface of actuator 28 against a bottom surface of upper cover part 14. In this "up" position, the cam surface 46 on cam wing 33 interacts with first blade summit 42 of first deformable conductive blade 40 to deflect first movable contact face 52 into direct contact with second fixed contact plate 23. While not shown, second blade summit 43 of second deformable conductive blade 41 is held in constant contact with guide wall 56, thereby permanently holding second movable contact face 53 in contact with first fixed contact plate 22. Thus, in this "closed" configuration, current is able to flow between first terminal 20 and second terminal 21 through movable contact element 36. As illustrated, cam surface 46 is configured to extend from cam wing 33 at a bottom portion of cam wing 33, which acts to deflect the first deformable conductive blade 40 when actuator 28 is in its "up" position. The size, shape, and/or length of cam surface 46 may be altered in order to provide pre-travel of actuator 28 in a vertically downward direction while still maintaining a closed contact between first movable contact face 52 and the second fixed contact plate 23.

However, as shown in FIG. 8B, when the free upper end 18 of actuator 28 is depressed, cam wing 33 is forced downward into housing 12 such that cam surface 46 no longer contacts first blade summit 42, thereby removing the contact between first movable contact face 52 and second fixed contact plate 23 so as to interrupt the flow of current between first terminal 20 and second terminal 21. The length of the non-camming surface 84 of cam wing 33 allows for overtravel of actuator 28, meaning that the disconnect between second movable contact face 53 and first fixed contact plate 22 is maintained for a prolonged axial actuation distance after the contact between second blade summit 43 and cam surface 46 is removed. It is to be understood that cam surface 46 may also be extended axially in some embodiments, thereby providing pre-travel in the "closed" position, as opposed to overtravel of actuator 28 in the "open" position.

When downward force upon free upper end 18 is released (either instantaneously or gradually), return spring 26 is biased to return actuator 28 toward upper cover part 14, with cam surface 46 again contacting first blade summit 42 to re-establish contact between first movable contact face 52 and second fixed contact plate 23, thereby restoring current flow between the first terminal 20 and the second terminal 21.

Figure 9A:
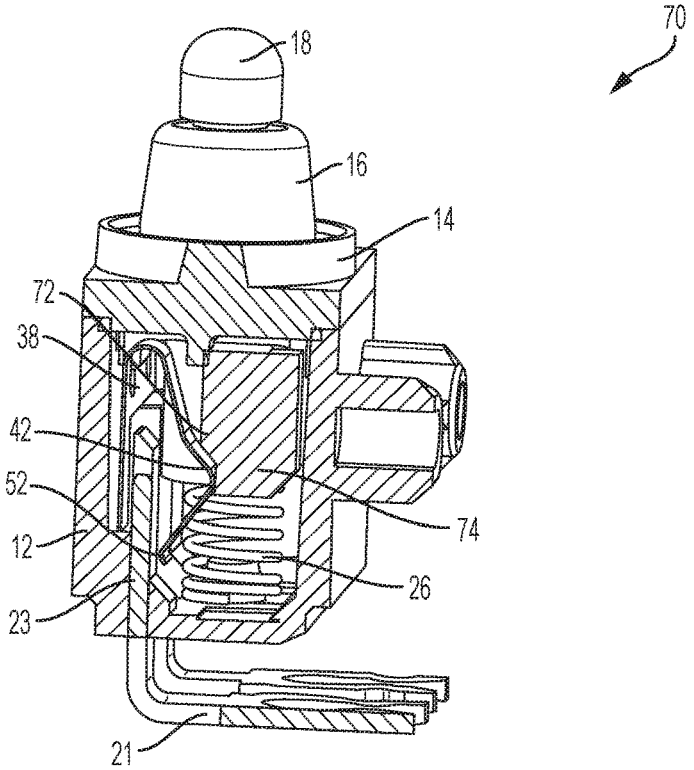
FIG. 9A is a normally-open switch in a first position in accordance with another aspect of the disclosure.
Figure 9B:
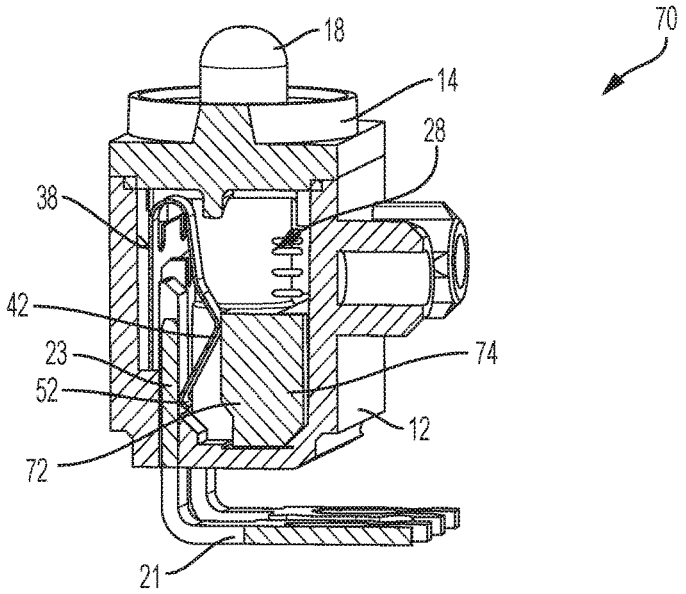
FIG. 9B is the normally-open switch of FIG. 9A in a second position in accordance with an aspect of the disclosure.

Next, referring to FIGS. 9A and 9B, a switch 70 in accordance with an alternative aspect of the disclosure is illustrated. As opposed to the "normally-closed" configuration shown in FIGS. 8A-8B, switch 70 is provided in a "normally-open" configuration. As shown in FIG. 9A, free upper end 18 of actuator 28 is in its "up" position (with the other portions of actuator 28 not shown since they are within upper cover part 14 and sealing boot 16), with return spring 26 holding the top surface of actuator 28 against a bottom surface of cover 14. In this "up" position, the cam surface 72 on cam wing 33 does not interact with first blade summit 42 of first deformable conductive blade 40, thereby holding first movable contact face 52 out of contact with the second fixed contact plate 23. Again, while not shown, second blade summit 43 of second deformable conductive blade 41 is held in constant contact with guide wall 56, thereby permanently holding second movable contact face 53 in contact with first fixed contact plate 22. Thus, in the "open" configuration shown in FIG. 9A, current is prevented from flowing between first terminal 20 and second terminal 21 through movable contact element 36.

Referring to FIG. 9B, when the free upper end 18 of actuator 28 is depressed, cam wing 33 is forced downward into housing 12 such that cam surface 72 enters into contact with the first blade summit 42, thereby deflecting first deformable conductive blade 40 so as to initiate contact between first movable contact face 52 and second fixed contact plate 23, thereby allowing current to flow between first terminal 20 and second terminal 21. If and/or when downward force upon the free upper end 18 is released (either instantaneously or gradually), return spring 26 is biased to return actuator 28 toward cover 14, with cam surface 72 eventually released from contact with the first blade summit 42 to open the contact between first movable contact face 52 and second fixed contact plate 23, which interrupts the flow of current between the first terminal 20 and the second terminal 21. Contrary to cam surface 46 described above with respect to FIGS. 8A-8B, cam surface 72 is configured to extend from cam wing 74 toward a top portion of cam wing 74, which acts to deflect the first deformable conductive blade 40 when actuator 28 is in its "down" position. However, similar to cam surface 46, the size, shape, and/or length of cam surface 72 may be altered in order to provide a varying degree of overtravel of actuator 28 when in a vertically downward direction in order to maintain (or release) a closed contact between first movable contact face 52 and the second fixed contact plate 23.

Accordingly, as illustrated above in the embodiments shown in FIGS. 8A-8B and FIGS. 9A-9B, respectively, the switch in accordance with aspects of the disclosure may be easily modified to form either a "normally-closed" or "normally-open" configuration, solely through modifications in the location, size, shape, etc. of a single cam surface on the actuator. Such a modification may be easily realized during the manufacturing process without necessarily requiring new tooling, moulds, etc., thereby allowing for customized configurations at reduced cost and complexity. Furthermore, the described configurations allow for the switch to be sealed, thereby allowing for its use in a variety of locations and environments.

Additionally, issues with durability, current limitations, and tactile feel present with switches having sliding contacts may be greatly reduced or eliminated, allowing the above-described switches to replace larger snap switches in higher current applications.

The general concept described above permits any arrangement of the establishment and interruption of conductive ways, in position and in number.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the disclosure. The terminology used herein was chosen to best explain the principles of the embodiment, the practical application or technical improvement over technologies found in the marketplace, or to enable others of ordinary skill in the art to understand the embodiments disclosed herein.

The invention claimed is:

1. An electrical switch comprising:

a housing;

an actuator configured to move axially within the housing between an upper position and a lower position, the actuator comprising:

a free upper end positioned at least partially outside of the housing and configured to receive a downward external force, a stem extending at least partially outside of the housing, wherein the free upper end is disposed on a distal end of the stem, a guide wing extending laterally from a first side, and a cam wing extending laterally from a second side opposite the first side, wherein the cam wing comprises a cam surface extending from a face of the cam wing;

a first contact terminal partially extending from the housing opposite the free upper end of the actuator, the first contact terminal comprising a first fixed contact plate disposed within the housing;

a second contact terminal partially extending from the housing opposite the free upper end of the actuator, the second contact terminal comprising a second fixed contact plate disposed within the housing; and a movable contact element retained within the housing proximate the first fixed plate and the second fixed contact plate, the movable contact element comprising:

a fixed branch, the fixed branch configured to be retained on an inner surface of the housing, a first elastically deformable conductive blade extending from a first side of the fixed branch, the first elastically deformable conductive blade having a first movable contact face, and a second elastically deformable conductive blade extending from a second side of the fixed branch opposite the first side, the second elastically deformable conductive blade having a second movable contact face;

wherein the cam surface on the cam wing of the actuator is configured to cooperate with the first elastically deformable conductive blade to deform or relax the first elastically deformable conductive blade for longitudinally moving the first movable contact face to come into contact, or out of contact, with the first fixed contact plate, dependent upon an axial position of the actuator within the housing.

2. The electrical switch according to claim 1, wherein the housing further comprises a guide wall extending within an interior portion of the housing, the guide wall being sized and configured to cooperate with the second elastically deformable conductive blade to deform the second elastically deformable blade such that the second movable contact face is held in contact with the second fixed contact plate regardless of the axial position of the actuator within the housing.

3. The electrical switch according to claim 2, wherein the guide wall is further configured to at least partially retain the guide wing of the actuator.

4. The electrical switch according to claim 1, wherein the cam wing further comprises an axially-extending guide slot.

5. The electrical switch according to claim 4, further wherein the guide slot is configured to cooperate with a guide rib extending within an interior portion of the housing so as to at least partially retain the cam wing of the actuator.

6. The electrical switch according to claim 1, wherein the cam surface extends from a portion of the cam wing proximate a bottom surface of the actuator.

7. The electrical switch according to claim 6, wherein the cam surface is configured to maintain the first movable contact of the first elastically deformable conductive blade in contact with the first fixed contact plate when the actuator is in the upper position.

8. The electrical switch according to claim 1, wherein the cam surface extends from a portion of the cam wing proximate a top surface of the actuator.

9. The electrical switch according to claim 8, wherein the cam surface is configured to maintain the first movable contact of the first elastically deformable conductive blade in contact with the first fixed contact plate when the actuator is in the lower position.

10. The electrical switch according to claim 1, further comprising a return spring, wherein the return spring is configured to bias the actuator toward the upper position.

11. The electrical switch according to claim 1, further comprising an upper cover portion, wherein the upper cover portion is configured to be couplable to the housing, and further wherein the stem of the actuator extends at least partially through the upper cover portion.

12. The electrical switch according to claim 11, further comprising a sealing boot, wherein the sealing boot is configured to at least partially surround the stem of the actuator.

13. An electrical switch comprising:

a housing, the housing comprising an interior portion having a guide rib extending from a first sidewall and a guide wall extending from a second sidewall opposite the first sidewall;

an actuator at least partially supported by the guide rib and the guide wall and configured to move axially within the housing between an upper position and a lower position, the actuator comprising:

a guide wing extending laterally from a first side, and a cam wing extending laterally from a second side opposite the first side, wherein the cam wing comprises a cam surface extending from a face of the cam wing;

a first contact terminal partially extending from the housing, the first contact terminal comprising a first fixed contact plate disposed within the housing;

a second contact terminal partially extending from the housing, the second contact terminal comprising a second fixed contact plate disposed within the housing; and a movable contact element retained within the housing proximate the first fixed plate and the second fixed contact plate, the movable contact element comprising:

a fixed branch, the fixed branch configured to be retained on an inner surface of the housing, a first elastically deformable conductive blade extending from a first side of the fixed branch, the first elastically deformable conductive blade having a first movable contact face, and a second elastically deformable conductive blade extending from a second side of the fixed branch opposite the first side, the second elastically deformable conductive blade having a second movable contact face;

wherein the cam surface on the cam wing of the actuator is configured to cooperate with the first elastically deformable conductive blade to deform or relax the first elastically deformable conductive blade for longitudinally moving the first movable contact face to come into contact, or out of contact, with the first fixed contact plate dependent upon an axial position of the actuator within the housing.

14. The electrical switch of claim 13, wherein the guide wall is configured to deform the second elastically deformable blade such that the second movable contact face is held in contact with the second fixed contact plate regardless of the axial position of the actuator within the housing.

15. The electrical switch of claim 13, wherein the cam surface extends from a portion of the cam wing proximate a bottom surface of the actuator.

16. The electrical switch according to claim 15, wherein the cam surface is configured to maintain the first movable contact of the first elastically deformable conductive blade in contact with the first fixed contact plate when the actuator is in the upper position.

17. The electrical switch according to claim 13, wherein the cam surface extends from a portion of the cam wing proximate a top surface of the actuator.

18. The electrical switch according to claim 17, wherein the cam surface is configured to maintain the first movable contact of the first elastically deformable conductive blade in contact with the first fixed contact plate when the actuator is in the lower position.

19. The electrical switch according to claim 13, further comprising a return spring, wherein the return spring is configured to bias the actuator toward the upper position, wherein a first end of the return spring is retained by a centering pin on a bottom interior surface of the housing, and further wherein a second end of the return spring is retained by a recess within the actuator.

20. The electrical switch according to claim 13, wherein the actuator further comprises a free upper end positioned at least partially outside of the housing and configured to receive a downward external force, and a stem extending at least partially outside of the housing, wherein the free upper end is disposed on a distal end of the stem.

* * * * *